United States Patent [19]

Bennett et al.

[11] 4,002,412

[45] Jan. 11, 1977

[54] STABILIZING OPEN GRADED ASPHALT-CONCRETE

[75] Inventors: Richard J. Bennett; Lew T. Gray; Dale F. Levy, all of Bartlesville, Okla.

[73] Assignee: Phillips Petroleum Company, Bartlesville, Okla.

[22] Filed: Mar. 27, 1975

[21] Appl. No.: 562,914

Related U.S. Application Data

[62] Division of Ser. No. 501,203, Aug. 28, 1974, Pat. No. 3,907,449.

[52] U.S. Cl. ..... 404/17; 404/72

[51] Int. Cl.[2] ..... E01C 7/00

[58] Field of Search ..... 404/32, 71, 19, 20, 404/72, 75, 17; 260/28.5

[56] References Cited

UNITED STATES PATENTS

| | | | |
|---|---|---|---|
| 851,625 | 4/1907 | Hassam | 404/72 |
| 2,003,888 | 6/1935 | Jamieson | 404/75 |
| 2,165,955 | 7/1939 | Haarhoff | 404/32 X |
| 2,413,901 | 1/1947 | Abernathy | 404/32 X |
| 3,093,601 | 6/1963 | Gessler | 260/5 |
| 3,344,721 | 10/1967 | Ferm | 404/75 |
| 3,592,788 | 7/1971 | Rostler | 260/28.5 |
| 3,645,947 | 2/1972 | Quigg | 260/28.5 |
| 3,707,901 | 1/1973 | Bynum | 404/71 |
| 3,801,421 | 4/1974 | Allen | 404/32 X |
| 3,900,687 | 8/1975 | Meader | 404/32 X |

*Primary Examiner*—Nile C. Byers, Jr.

[57] ABSTRACT

A method is provided for stabilizing an open graded course of asphalt-concrete against lateral displacement under a moving load. The method which is suitable for use during construction of the asphalt-concrete course or on courses already completed is carried out by causing particulate matter of suitable size to be passed into the interstices of the asphalt-concrete course and then consolidating this particulate matter within the interstices using an emulsion of a thermoplastic elastomer, a resinous material and a polar solvent which upon curing forms a stabilized course.

2 Claims, No Drawings

STABILIZING OPEN GRADED ASPHALT-CONCRETE

This is a divisional application of our copending application having Ser. No. 501,203, filed Aug. 28, 1974 now U.S. Pat. No. 3,907,449.

BACKGROUND OF THE INVENTION

This invention relates to asphalt-concrete paving. In one of its aspects this invention relates to the stabilization of open graded surface asphalt-concrete courses. In another of its aspects this invention relates to preventing lateral displacement of a paved surface under a moving load.

An open graded course of an asphalt-cement aggregate mix is a thin, porous layer of aggregate one-half inch to two inches, more commonly three-fourth inch to one and one-half inches, thick after compaction, designed to allow rapid drainage of rain water from a paved surface. Since this surface is especially designed to prevent the buildup of water layers which might lead to hydroplaning conditions, these surfaces are usually found on roadways but are more especially useful in airport aprons and runways.

These pavements have intersticial voids and are not as compact as the underlying bearing surface so that the impact and rolling motion of a large vehicle, such as a large plane, tend to displace the open graded overlay thereby producing hills and valleys along a paved area such as a runway or airport apron. This can become a problem on roadways at intersections where large trucks are caused to stop but is an especially aggravated problem in the turning area of multi-wheeled planes. We have found that the problem of lateral displacement or "shoving" of an asphalt-concrete course under a moving load can be alleviated by a two-step treatment of an open graded course of an asphalt-cement aggregate either at the time of construction or after the pavement is set and a problem of displacement has been noticed.

Other aspects and the several advantages of this invention will be apparent to those skilled in the art upon reading the disclosure and the appended claims to this invention.

SUMMARY OF THE INVENTION

Accordingly, a method is provided for stabilizing an open graded course of asphalt-concrete against lateral displacement under a moving load. The method comprises first causing particulate matter to be passed into the interstices of the asphalt-concrete course and then consolidating the particulate matter within the interstices using an emulsion comprising a thermoplastic elastomer, a resinous material and a polar solvent.

In one embodiment of the invention an open graded course of asphalt-concrete stabilized against lateral displacement under a moving load is provided. The stabilized course is composed of an open graded course of asphalt-concrete, particulate matter within the interstices of the course, and a cohering material comprising a cured composition of a thermoplastic elastomer and a resinous material consolidating the particulate matter within the interstices.

DESCRIPTION OF THE PREFERRED EMBODIMENTS

By the method of this invention any of the types of particulate matter having sufficient strength to be used in paving construction when reduced to a size capable of entering the interstices of an open graded course of asphalt-concrete is suitable for use in this invention. The most common particulate material suitable for this use is sand. The sand or other particulate material should be of a size of 60 mesh or finer to be able to enter the interstices. Since the drainage characteristics of the asphalt-cement course are sought to be retained, it is preferred that a lower limit of particle size should be not less than 200 mesh.

The particulate matter is applied at a rate of about 2 to about 5 pounds per square yard of surface, preferably from about 3 pounds to about 4 pounds per square yard of surface. A broom or rotary brush can be used to distribute the sand across the surface and cause it to enter the interstices of the asphalt-concrete course. Another method for insinuating the particulate matter into the interstitial space of the asphalt-concrete course is to vibrate the pavement. The vibration will cause the particulate matter to sift into the interstices. The pavement can be vibrated by a suitable device such as a vibrating roller. If the open graded layer is exceptionally deep, i.e., above 1.5 inches, a combination of the brushing and vibrating methods can be used.

After the particulate matter has been insinuated into the structure of the asphalt-concrete pavement, the pavement is treated with a rock binding emulsion of solvent-water and rubber. This emulsion penetrates into the pavement and deposits a small cementing quantity of high green strength rubber at the contact points of the particles. This deposition at the contact points is sufficient to cohere the particles but not sufficient to interfere with the porosity of the structure. In this way the pavement is not sealed or made sufficiently impermeable to interfere with runoff of water from the surface. To maintain this balance of properties the solvent-water-rubber emulsion is sprayed on the pavement at a rate of about 0.2 to about 1.5 gallons per square yard of surface, preferably from about 0.3 to about 0.75 gallons per square yard of surface.

The preferred elastomeric bonding agent is a thermoplastic elastomer of the block copolymer type, or of the trans-diene polymer type, or a blend of the two polymers. An informative paper on the influence of structure and composition on properties of block copolymers has been publishd by Childers and Kraus in "Rubber Chemistry and Technology," 40 (4) 1183–1199 (September, 1967). Since no claim is made to the polymers per se, and since they have been described in the prior art, it will be sufficient to refer to the abovecited literature and also to U.S. Pat. Nos. 2,975,160; 3,113,912; 3,251,905; 3,231,635; 3,239,478; 3,242,038; 3,265,765; 3,299,174; and 3,333,024; which pertain to block copolymers.

For a discussion of the present state of knowledge pertaining to block copolymers, their chemical constitution, the influence of molecular weight of the constituent blocks, etc., see particularly the research papers by Childers and Kraus.

We prefer to use the poly(styrene)-poly(butadiene)-poly(styrene) block copolymers having the conjugated diene blocks of molecular weight between 2,000 and 1,000,000, and the end blocks having a molecular weight between 2,000 and 100,000.

Other block copolymers such as poly(styrene)-poly(acrylonitrile)-poly(styrene), poly(styrene)-poly(isoprene)-poly(styrene), or other combinations of plastic elastic block polymers may also be used. Those skilled in the art will also be able to substitute, for block copolymers, graft polymers or polymers stiffened by incorporation of organic fillers as long as this fulfills the requirements of the characteristics for which the block copolymers are chosen in accord with the present invention, i.e., capable of developing material strength without the step of vulcanization by heat.

The elastomers may be stiffened by adding a stiffening resin in the form, for example, of an amorphous resin. A suitable stiffening resin may be a polymer of styrene or coumarone-indene resin. The resin should have properties which are similar to those of the coumarone-indene type, and resins derived from coal tar or petroleum can be used. The preferred softening point range of the amorphous resin is from about 140° F to 300° F. The main characteristics of the resin are that it is compatible with the block copolymer, is amorphous, and does not possess the elastomeric properties of being extensible and retractable.

An extender oil, such as commonly used in rubber compounding and described in ASTM Method D22226, *Description of Types of Petroleum Extender Oils*, may also be used. The use of extenders is well known. However, it is preferred to use a minimum concentration of such extender oil which will produce the desirable qualities of the composition set forth herein, and preferably to omit such oil entirely.

The preferred elastomeric bonding agent, modified as desired by the addition of a stiffening resin, or an extender, or both, may be applied dissolved in a volatile solvent or applied in the form of an emulsion. Antioxidants and antiozonants, such as commonly used to inhibit the attack of oxygen and ozone on rubber compounds, may be added to the composition to improve the aging properties of the binder.

The polymer may be applied to the aggregate as a dispersion, either as solution in a solvent or as an emulsion. Suitable solvents are low boiling, e.g., below about 125° C, chlorinated hydrocarbons, such as trichloroethylene, and aromatic solvents such as benzene, toluene, and xylene. Coal tar naphthas containing these chemicals may also be used. One skilled in the art may select various suitable solvents or azeotropes from those listed in the literature, e.g., *Solvents Guide*, by Marsden and Mann (Cleaver-Hume Press Ltd., London). Compositions suitable for use in this procedure are described in U.S. Pat. No. 3,788,883 (F. S. Rostler et al Jan. 29, 1974), herein incorporated by reference and more specifically described in the example which follows below.

The preferred cohering material used in this invention is an emulsion comprising thermoplastic elastomer of a butadiene-styrene block copolymer type dissolved in a suitable solvent, a resinous material, and a polar solvent substantially as described above, sold by Phillips Petroleum Company under the tradename Petroset RB. This material produces a bonding agent which, without vulcanization, has, as shown by standard stress strain tests, more than ten times the strength of conventional rubbers.

The method for bonding the particulate matter is as follows. The particulate matter containing pavement is washed with water and allowed to drain. The Petroset emulsion is then sprayed on the particulate matter and "breaks" thereby depositing the cementing agent at these points of contact. After a few hours, the cementing agent develops into small, individual elastomeric vibration pads at the points of contact which weld the treated particulate matter into an elastomeric consolidated structure. It has been found that heat can be used to cure the consolidated structure more rapidly; preferably steam or hot air is used in such curing process.

Additionally, it has been found that it is sometimes useful after the particulate matter containing pavement has been washed with water and allowed to drain that it can be sprayed with a dilute alkaline solution of concentration range of approximately 0.5 to 5 percent, preferably 1 to 3 percent, and allowed to drain again. The dilute alkaline solution can be selected from solutions of sodium hydroxide, sodium bicarbonate, sodium carbonate and preferably ammonia. Part of the solution is held between the individual particles by capillary forces at the points where the particles come into contact with each other. Upon spraying Petroset emulsion onto the particulate matter, contact with the alkaline solution held at the points where one particle contacts another in the interstices of the pavement causes the emulsion to break depositing the cementing agent at the points of contact. The addition of this step to the process helps to assure better bonding of individual particles.

The following example is a test which was made at a commercial airport. This test illustrates an embodiment of the invention to show its operativeness and should be taken as illustrative and not exclusive.

EXAMPLE

At an airport, four areas 3 x 10 feet were selected so that gear assemblies from heavy loaded aircraft would pass over, as well as pivot, in the test areas as these aircraft were being pushed from gate areas. These areas had been overlaid with a one-inch thick layer of open mix having the following specifications:

| Aggregate Sieve Size | Percent Passing |
|---|---|
| ½" | 100 |
| ⅜" | 95 |
| No. 4 | 44 |
| No. 16 | 12 |
| No. 200 | 2 |

This had been mixed with six percent by weight of a bituminous binder and applied at 240° F. The course had been laid and had been in service for about one year.

About 3–4 pounds of 70-mesh sand were applied, using hand brooms to distribute the sand evenly into the void space; the final amount of sand in place was estimated at 2–3 lbs./sq. yard.

Area 1: Solvent-water-rubber emulsion was diluted with two parts of water and applied at 0.5 gal./sq. yd.

Area 2: Was first wetted with fine water spray and then 1:2 emulsion: water was applied at the rate of 0.5 gal./sq. yd.

Area 3: Same as Area 1 but dilution ratio was 1:1.

Area 4: Same as Area 2 with dilution ratio 1:1.

The undiluted solvent-water-rubber solution had the following composition:

| Ingredient | Wt. % |
|---|---|
| Butadiene/styrene 60/40 block copolymer, 40% polystyrene[1] | 22 |
| Coumarone-Indene Resin[2] | 11 |

-continued

| Ingredient | Wt. % |
|---|---|
| Trichloroethylene | 24.8 |
| Xylene | 16.6 |
| Cyanox SS[3] | 0.3 |
| Nickel dibutyldithiocarbamate | 0.3 |
| 50% Hyamine 2389[4] | 2.0 |
| Redicote E-1[5] | 0.5 |
| 31.5% HCl | 0.45 |
| Methanol | 2.0 |
| Water | 20.05 |

[1]Solprene 414, Phillips Petroleum Company.
[2]Neville Resin R16A, Neville Manufacturing Co.
[3]2,2'-methylene-bis-(4-methyl-6 tert butyl phenol) - American Cyanamid Corp.
[4]Methyldodecylbenzyl trimethyl ammonium chloride and methyldodecyl xylene bis(trimethyl ammonium chloride), cationic emulsifier - Rohm and Haas.
[5]Tallow Diamines - Armour Industrial Chemicals.

Four days after applying the treatment, the test sites were inspected and all areas were stabilized. Cores were obtained and showed that Sections 1 and 2 had the deepest penetration of the rubber emulsion (dilution ratio 1:2) into the open graded layer. Another inspection, about two weeks later, showed no deformation of the treated section, no loss of aggregate, no rutting. The area was still in good shape six months later.

Reasonable variation and modification are possible within the scope of the foregoing disclosure and the appended claims the essence of which is that an open graded course of asphalt-concrete can be stabilized against lateral displacement under a moving load by insinuating fine particulate matter into the interstices of the pavement and consolidating the particulate matter with a rubber emulsion treatment without softening the asphaltic or bituminous component of the asphalt-cement-aggregate mix so that the structural integrity of a relatively thin top layer of pavement can be improved without affecting the bearing courses of pavement beneath this top layer of specialized construction.

We claim:

1. An open graded course of asphalt-concrete stabilized against lateral displacement under a moving load comprising:

1. an open graded course of asphalt-concrete,
2. particulate matter within the interstices of said course of asphalt-concrete, and
3. a cured composition of cohering material comprising a thermoplastic elastomer and a resinous material consolidating said particulate matter within the interstices.

2. The stabilized course of asphalt-concrete of claim 1 wherein said particulate matter is sand and said thermoplastic elastomer is a butadiene-styrene block copolymer, and the resinous material is chosen from among polymers of styrene and coumarone-indene resin.

* * * * *